US009134659B2

(12) United States Patent
Kanematsu

(10) Patent No.: US 9,134,659 B2
(45) Date of Patent: Sep. 15, 2015

(54) FIXING DEVICE AND IMAGE FORMING APPARATUS

(71) Applicant: KYOCERA DOCUMENT SOLUTIONS INC., Osaka (JP)

(72) Inventor: Yoshiharu Kanematsu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/154,867

(22) Filed: Jan. 14, 2014

(65) Prior Publication Data

US 2014/0199099 A1 Jul. 17, 2014

(30) Foreign Application Priority Data

Jan. 16, 2013 (JP) ..... 2013-005339

(51) Int. Cl.
*G03G 15/20* (2006.01)

(52) U.S. Cl.
CPC ..... *G03G 15/2028* (2013.01)

(58) Field of Classification Search
USPC ..... 399/110, 122, 320, 322, 323, 328, 329
See application file for complete search history.

(56) References Cited

U.S. PATENT DOCUMENTS

| | | | | |
|---|---|---|---|---|
| 7,613,421 | B2 | 11/2009 | Kanematsu et al. | |
| 8,532,550 | B2 * | 9/2013 | Arakawa | 399/323 |
| 2004/0156659 | A1 * | 8/2004 | Ando et al. | 399/323 |
| 2007/0048036 | A1 | 3/2007 | Kanematsu et al. | |

FOREIGN PATENT DOCUMENTS

| | | | |
|---|---|---|---|
| JP | 04-324470 | A | 11/1992 |
| JP | 2006-058372 | A | 3/2006 |
| JP | 2007-065342 | A | 3/2007 |
| JP | 2007-079457 | A | 3/2007 |
| JP | 2011-065121 | A | 3/2011 |

OTHER PUBLICATIONS

An Office Action; "Notice of Reasons for Rejection," issued by the Japanese Patent Office on May 19, 2015, which corresponds to Japanese Patent Application No. 2013-005339 and is related to U.S. Appl. No. 14/154,867.

* cited by examiner

*Primary Examiner* — Hoan Tran
(74) *Attorney, Agent, or Firm* — Studebaker & Brackett PC

(57) ABSTRACT

A fixing device includes a fixing member, a pressure member, and a separation roller. The fixing member is configured to rotate in a first direction. The pressure member is configured to rotate in a second direction so as to allow fixing target to pass between the fixing member and the pressure member. The separation roller is configured to rotate only in the same direction as the first direction to separate the fixing target from the fixing member or to rotate only in the same direction as the second direction to separate the fixing target from the pressure member.

19 Claims, 8 Drawing Sheets

FIXING DEVICE AND IMAGE FORMING APPARATUS

INCORPORATION BY REFERENCE

The present application claims priority under 35 U.S.C. §119 to Japanese Patent Application No. 2013-005339, filed Jan. 16, 2013. The contents of this application are incorporated herein by reference in their entirety.

BACKGROUND

The present disclosure relates to fixing devices and image forming apparatuses including a fixing device.

Image forming apparatuses, such as copiers, printers, and facsimile machines, include an image forming section and a fixing device. The image forming section forms a toner image and transfers the formed toner image to paper (fixing target). Subsequently, the fixing device fixes the transferred toner image to the paper. Thus, the image is formed on the paper. A general fixing device includes a fixing roller which heats and melts a toner image to fix the toner image to paper and a pressure roller which applies pressure to paper against the fixing roller.

The adhesiveness of the melted toner may cause paper to be wound to the outer peripheral surface of the fixing roller or the pressure roller in the fixing device in some cases. To tackle this problem, there is known a fixing device which additionally includes a separation means to separate paper wound around the fixing roller or the pressure roller from the fixing roller or the pressure roller.

For example, a fixing device is known which includes, as a separation means, a separation claw in contact with a roller. The separation claw comes into contact with the lead edge of paper that has passed on the roller. This can separate the paper from the roller. Thus, the paper can be prevented from being wound around the roller.

Where the separation claw is used as a separation means, the separation claw is in contact with the roller to rub a mold release layer coated on the surface of the roller. This may wear out the mold release layer. Further, such wearing out may tend to shorten the lifetime of the roller.

To tackle this problem, a fixing device is proposed in which the position of the separation claw in contact with the surface of the roller is changed to avoid local damage of the roller (hereinafter referred to as a first fixing device).

The first fixing device can avoid local damage of the roller to delay replacement of the roller. However, even in the first fixing device, the lifetime may be shortened due to wearing out since the separation claw is in contact with the roller. Further, in the first fixing device, paper dust or toner gathered by the separation claw in contact with the roller may return to the roller to cause significant impairment of the image quality. Moreover, where the separation claw is in contact with a fixing roller, which is to be heated to high temperature, a heat resistant material must be used as a material for the separation claw, which may invite an increase in manufacturing cost.

In order to avoid the above problems, which are cased due to contact between the separation claw and the roller, a fixing device is proposed which uses a separation plate as a separation means (hereinafter referred to as a second fixing device). In the second fixing device, the separation plate is arranged so as to be out of contact with the roller. This may prevent the lifetime of the roller from being shortened and the image quality from being impaired. In turn, an increase in manufacturing cost can be suppressed.

SUMMARY

A fixing device according to the present disclosure includes a fixing member, a pressure member, and at least one separation roller. The fixing member is configured to rotate in a first direction. The pressure member is configured to rotate in a second direction so as to allow a fixing target to pass between the fixing member and the pressure member. The at least one separation roller is configured to rotate only in the same direction as the first direction to separate the fixing target from the fixing member or to rotate only in the same direction as the second direction to separate the fixing target from the pressure member.

An image forming apparatus according to the present disclosure includes the above fixing device.

DETAILED DESCRIPTION

First Embodiment

With reference to the accompanying drawings, description will be made below about an image forming apparatus 100 and a fixing device 10 according to the first embodiment of the present disclosure. However, the present disclosure is not limited to the following embodiments.

Figure 1:
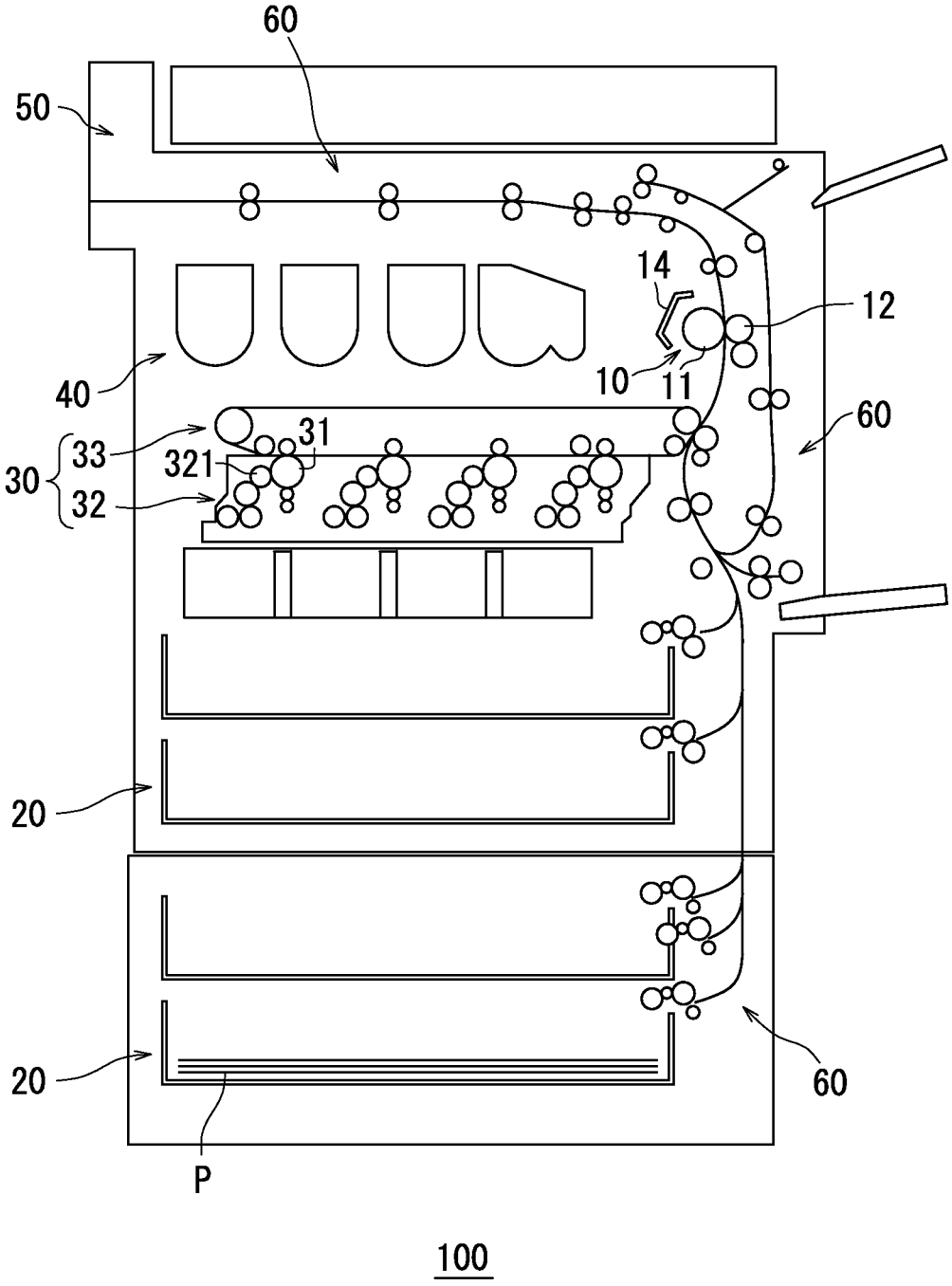
FIG. 1 is a diagram showing an image forming apparatus according to the first embodiment of the present disclosure.

FIG. 1 is a diagram showing an image forming apparatus 100 according to the present embodiment. The case where the image forming apparatus 100 is a copier will be described below. However, the image forming apparatus 100 is not limited to a copier and may be any of copiers, printers, facsimile machines, and multifunction peripherals having functions of them, for example.

The image forming apparatus 100 includes a fixing device 10, paper feed cassettes 20, an image forming section 30, a toner replenishment device 40, an ejection section 50, a conveyance section 60, and an image reader (not shown).

Paper P for printing (a fixing target) is accommodated in each paper feed cassette 20. In performing copying, the conveyance section 60 conveys paper P in one of the paper feed cassettes 20. The paper P is ejected from the ejection section 50 via the image forming section 30 and the fixing device 10.

The image forming section 30 forms a toner image and transfers the formed toner image to the paper P. The image forming section 30 includes a photoreceptor 31, a development device 32, and a transfer device 33.

Laser is irradiated to the photoreceptor 31 on the basis of electronic signals of an original document image generated in the image reader. Thus, an electrostatic latent image is formed on the photoreceptor 31. The development device 32 includes a development roller 321. The development roller 321 supplies toner to the photoreceptor 31 to develop the electrostatic latent image. Thus, a toner image is formed on the photoreceptor 31. The toner replenishment device 40 replenishes the development device 32 with toner.

The transfer device 33 transfers the toner image formed on the photoreceptor 31 to the paper P.

The fixing device 10 applies heat and pressure to the paper P. This makes the unfixed toner image formed in the image forming section 30 to be melted and fixed to the paper P.

Figure 2:
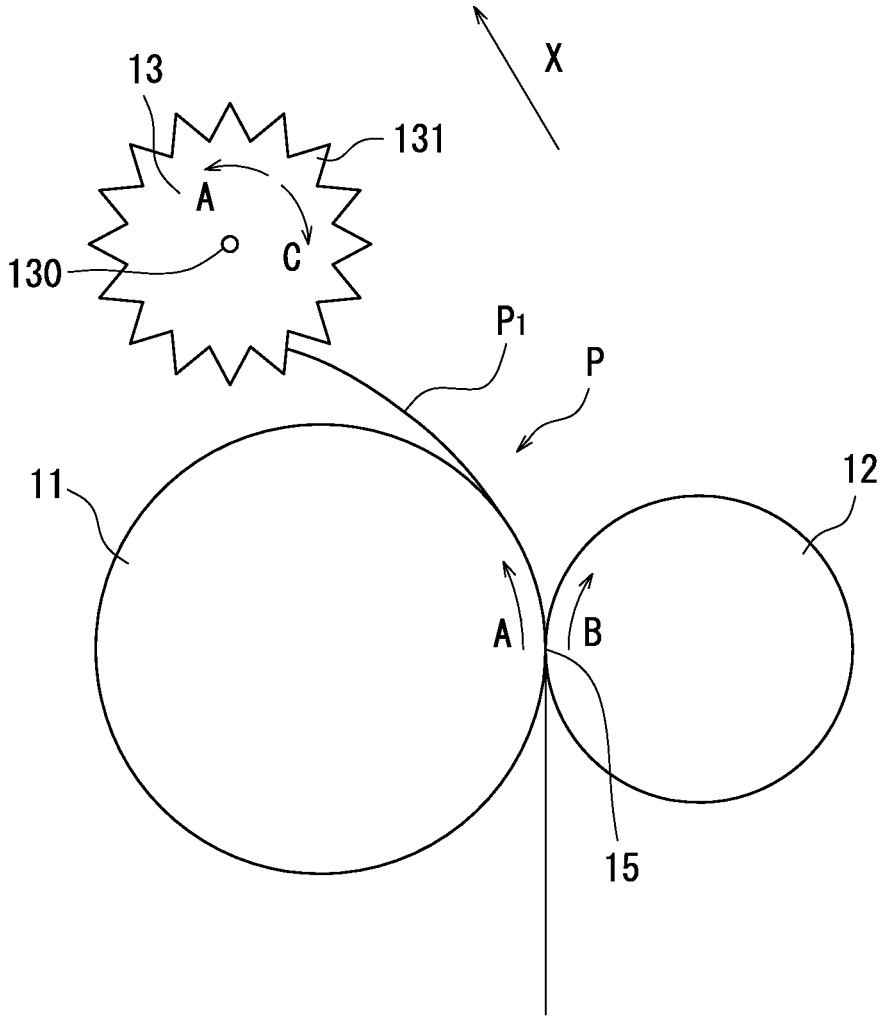
FIG. 2 is a diagram showing a fixing device according to the first embodiment of the present disclosure.

The fixing device 10 according to the present embodiment will be described with reference to FIGS. 1 and 2. FIG. 2 is a diagram showing the fixing device 10 according to the present embodiment.

The fixing device 10 includes a fixing member 11, a pressure member 12, and a separation roller 13.

The fixing member 11 is in contact with the pressure member 12. This forms a nip 15 at the contact part. Paper P is interposed between the fixing member 11 and the pressure member 12 in the nip 15. Rotation of the fixing member 11 in a first direction A (anticlockwise direction in FIG. 2) and rotation of the pressure member 12 in a second direction B (clockwise direction in FIG. 2) convey the paper P downstream in a conveyance direction X. Description will be made below about an example where the conveyance section 60 conveys paper P so that the surface of the paper P, on which a toner image is formed, comes into contact with the fixing member 11. However, in the conveyance section 60 of the image forming apparatus 100 may convey paper P so that the surface of the paper P, on which a toner image is formed, comes into contact with the pressure member 12.

The fixing member 11 rotates in the first direction A, while heating the paper P passing through the nip 15. This melts the toner on the paper P. In the present embodiment, a heating roller is used as the fixing member 11. Further, a heat source 14 (see FIG. 1) to heat the fixing member 11 is arranged in the vicinity of the fixing member 11. The heat source 14 heats the fixing member 11. The fixing member 11 comes into contact with the paper P in the nip 15. Accordingly, the paper P is heated in the nip 15.

It is noted that a hollow part may be formed in the heating roller, and the heat source may be arranged therein. The heat source arranged in the hollow part (heat source built in the interior of the heating roller) can heat the heating roller.

An endless heating belt can be used as the fixing member 11. A heat source to heat the heating belt may be arranged inside or outside the heating belt. Where the heating belt is used, a belt support member (e.g., a support roller) that is in contact with the inner surface of the heating belt is provided inside the heating belt. This enables the heating belt to be in contact with the pressure member 12 at a predetermined point or by a predetermined width (in turn, contact area).

The heat source 14 to heat the fixing member 11 may be a halogen lamp, a ceramic heater, a carbon heater, or an induction heater (IH). Further, in order to enhance releasability, the outer peripheral surface of the fixing member 11 may be subjected to coating treatment with a fluorinated material, for example.

The pressure member 12 rotates in the second direction B opposite to the first direction A, while applying pressure to the paper P passing through the nip 15.

A pressure roller may be used as the pressure member 11. The outer peripheral surface of the pressure member 12 may be subjected to coating treatment with a fluorinated material.

The separation roller 13 separates paper P wound around the fixing member 11 from the fixing member 11. The separation roller 13 is arranged downstream of the fixing member 11 in the conveyance direction X of paper P. The separation roller 13 is out of contact with the outer peripheral surface of the fixing member 11. The distance between the separation roller 13 and the fixing member 11 may be 0.2 mm or larger and 5 mm or smaller, for example. The separation roller 13 rotates only in the same direction as the first direction A. The rotational axis of the separation roller 13 is in parallel to the rotational axis of the fixing member 11.

Projected portions and recessed portions can be formed in or on the outer peripheral surface of the separation roller 13. In the present embodiment, a plurality of adjacent projected portions 131 are formed on the outer peripheral surface of the separation roller 13. Recessed portions are formed between the projection portions 131. In the present embodiment, each projected portion 131 has a wedged shape (e.g., conical shape) tapered (reduced in diameter of the projected portion 131) as it goes to its tip end (radially outward of the separation roller 13). However, each projected portion 131 may have a prismatic shape, a truncated conic/pyramid shape, a pyramid shape, or the like. Further, the projected portions 131 may be formed at regular intervals in the circumferential direction of the separation roller 13.

The separation roller 13 in the present embodiment is arranged near the fixing member 11, which is to be heated up to about 200° C. For this reason, the separation roller 13 is preferably made of heat resistant resin having a heat resistance temperature of 200° C. or higher. The heat resistant resin that forms the separation roller 13 may be polyimide (PI), polyamidimide (PAI), liquid crystal polymer (LCP), polyphenylene sulfide (PPS), or polyether sulfone (PES), for example. Further, in order to improve slippage of paper P on the separation roller 13, it is preferable to coat the surface of the separation roller 13 with a fluororesin layer. The fluororesin for coating may be polytetrafluoroethylene (PTFE), perfluoro alkoxy alkane (PFA), ethylene-tetrafluoroethylene copolymer (ETFE), or fluorinated ethylene propylene (FEP), for example.

Figure 3:
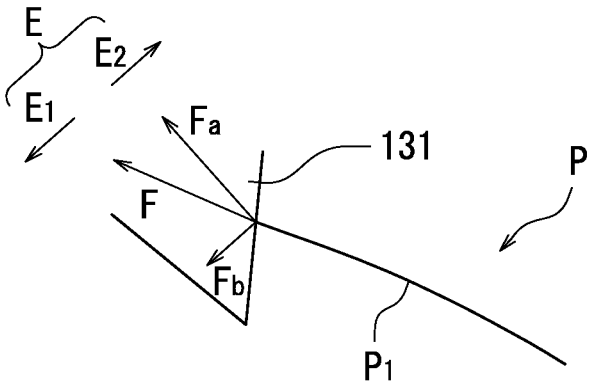
FIG. 3 is a diagram showing paper coming into contact with a projected portion of a separation roller in the fixing device according to the first embodiment of the present disclosure.

FIG. 3 is a diagram showing paper P coming into contact with a projected portion 131 of the separation roller 13. An operation of the fixing device 10 according to the present embodiment will be described below with reference to FIGS. 2 and 3. In the fixing device 10 of the present embodiment, the separation roller 13 separates paper P from the fixing member 11 in conveyance of the paper P.

The image forming section 30 forms a toner image on paper P in the image forming apparatus 100. Then, the paper P passes through the nip 15 from its lead edge P1 and is then conveyed downstream in the conveyance direction X. As shown in FIG. 2, the adhesiveness of the melted toner causes part of the paper P, which has passed through the nip 15, to be wound around the fixing member 11 to some extent. However, the lead edge P1 of the paper P is out of contact with the fixing member 11 in the presence of the resilience that the paper P itself has.

When the fixing member 11 and the pressure member 12 further rotate to make the paper P further advance downstream in the conveyance direction X, the lead edge P1 of the paper P comes into contact with the separation roller 13. At that time, the separation roller 13 is pushed by a force that conveys the paper P (hereinafter referred to as a force F). In detail, the force F acts on the contact point (point of action) between the lead edge P1 of the paper P and the separation roller 13.

At the point of action of the force F, the force F can be resolved between a force component Fa and a force component Fb, which are orthogonal to each other, as shown in FIG. 3, for example. The force component Fa acts toward the center 130 of rotation (rotational axis) of the separation roller 13. The force component Fb acts in the direction (hereinafter referred to as a direction E) orthogonal to the force component Fa on the same plane as that on the force F and the force component Fa (each is a vector). The direction of the force component Fb varies depending on the point in the separation roller 13 with which the lead edge P1 of the paper P comes into contact.

For example, when the lead edge P1 of paper P comes into contact with the separation roller 13 at a point shown in FIG. 3, the force component Fb acts rightward (direction indicated by the arrow E1) from the point of action as viewed from the center 130 of rotation of the separation roller 13. By contrast, when the lead edge P1 of the paper P comes into contact with the separation roller 13 at a point different from the point shown in FIG. 3, the force component Fb may act leftward (direction indicated by the arrow E2) from the point of action as viewed from the center 130 of rotation of the separation roller 13.

The force component Fa acts in the direction toward the center 130 of rotation of the separation roller 13. For this reason, the force component Fa generates no torque for rotating the separation roller 13. By contrast, the force component Fb generates torque for rotating the separation roller 13. Depending on the direction in which the force component Fb acts, the direction of the torque that the force component Fb generates varies. Description will be made below about respective operations of the separation roller 13 when the force component Fb acts in the direction E1 to generate torque and when the force component Fb acts in the direction E2 to generate torque.

When the force component Fb acts in the direction E1 to generate torque, the force component Fb attempts to rotate the separation roller 13 in a direction C by the torque operation. However, in the present embodiment, the separation roller 13 is so configured to rotate only in the first direction A. Accordingly, a reaction force acting in a direction opposite to the direction of the torque acts on the separation roller 13 that receives the torque operation. The reaction force acts in a direction in which the separation roller 13 rotates in the first direction A. In this state, the rotation of the separation roller 13 in the first direction A is not restricted. Accordingly, the reaction force rotates the separation roller 13 in the first direction A.

By contrast, when the force component Fb acts in the direction E2 to generate torque, the separation roller 13 is rotated in the first direction A by the torque operation.

As described above, in the present embodiment, the force component Fb is included in the force F that the lead edge P1 of paper P applies to the separation roller 13. Even when the direction in which the force component Fb acts is either the direction E1 or the direction E2, the separation roller 13 is rotated in the first direction A. The lead edge P1 of the paper P receives a force in a direction away from the fixing member 11 by the rotation of the separation roller 13. This can guide the paper P downstream in the conveyance direction X.

As described above, the paper P passes between the fixing member 11 and the pressure member 12 in the fixing device 10 of the present embodiment. When the lead edge P1 of paper P comes into contact with the separation roller 13, the force F rotates the separation roller 13 in the first direction A (the same direction as the direction in which the fixing member 11 rotates in conveyance of the paper P) to separate the lead edge P1 of the paper P from the fixing member 11 and to guide the paper P downstream in the conveyance direction X. Thus, the paper P can be separated from the fixing member 11. Further, the paper P can be conveyed with the lead edge P of the paper P facing downstream in the conveyance direction X. Thus, occurrence of a paper jam and/or a dog ear can be reduced which may be caused by conveyance of the paper P in an undesirable direction, for example, between the separation roller 13 and the fixing member 11.

The separation roller 13 is arranged so as to be out of contact with the fixing member 11 in the fixing device 10 of the present embodiment. Accordingly, a low-cost material (material of which heat resistance temperature is comparatively low) can be used as a material for the separation roller 13. This can reduce the manufacturing cost. Further, no wearing out of the coating layer by contact between the fixing member 11 and the separation roller 13 can be caused. Thus, the lifetime of the fixing member 11 or the separation roller 13 can be extended. Moreover, no impairment of image quality, which may be caused by contact between the fixing member 11 and the separation roller 13, may be caused. Thus, the quality of an image that the image forming apparatus 100 forms can be improved.

As described above, the fixing device 10 and the image forming apparatus 100 according to the present embodiment can be manufactured at low cost and have comparatively long lifetimes. Further, in the fixing device 10 and the image forming apparatus 100 according to the present embodiment, impairment of image quality and occurrence of a paper jam can be reduced.

Second Embodiment

Figure 4:
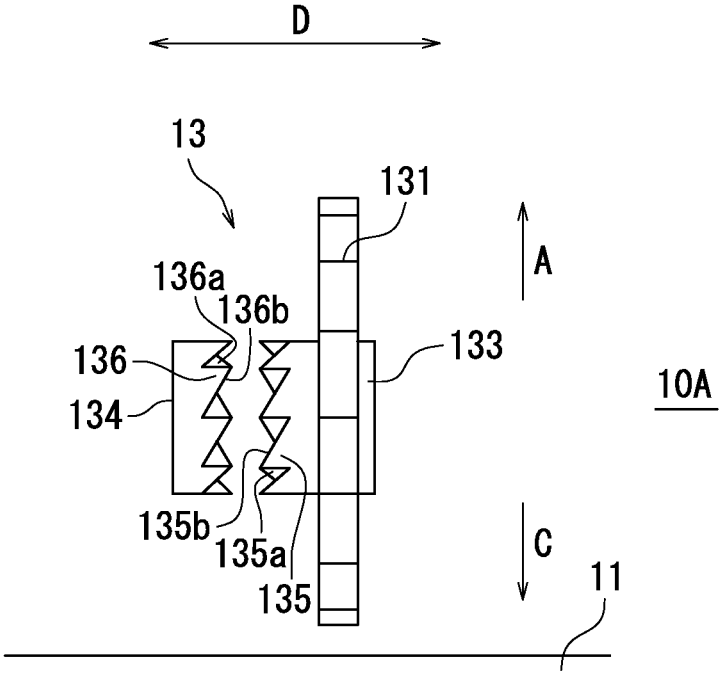
FIG. 4 is a diagram showing a fixing device according to the second embodiment of the present disclosure.

FIG. 4 is a diagram showing a fixing device 10A according to the second embodiment of the present disclosure. With reference mainly to FIG. 4, the second embodiment of the present disclosure will be described below with focus placed upon difference from the first embodiment. Like numerals denote like elements shown in FIGS. 1-3 for explanation. Description overlapping with that of in the first embodiment will be omitted or simplified.

A fixing device 10A according to the present embodiment includes a fixing member 11, a pressure member 12 (not shown in FIG. 4), and a separation roller 13. The fixing member 11 and the pressure member 12 have configurations similar to those of the fixing member 11 and the pressure member 12 in the first embodiment (see FIGS. 1-3), respectively.

As a rotation direction restricting mechanism, the separation roller 13 includes a rotary member 133 and a restricting member 134. The rotation direction restricting mechanism restricts rotation of the separation roller 13 in one rotation so that the separation roller 13 rotates only the other direction.

The rotary member 133 is rotatably arranged at a location which is out of contact with the fixing member 11. The rotary member 133 is arranged a predetermined distance apart from the outer peripheral surface of the fixing member 11. Projected portions 131 are formed on the outer peripheral surface of the rotary member 133. Ratchet teeth 135 are formed on the rotary member 133.

The ratchet teeth 135 in the present embodiment each include a flat surface portion 135*a* and an inclined surface portion 135*b*. The flat surface portion 135*a* is formed in parallel to the direction of the axis of the rotary member 133

(direction indicated by the arrow D). The inclined surface portion 135*b* is formed to cross the direction D. The ratchet teeth 135 are formed in a circle on one of the side surfaces of the rotary member 133 which face in the direction D.

The restricting member 134 is arranged adjacent to the rotary member 133. The restricting member 134 includes ratchet pawls 136. The ratchet pawls 136 are formed so as to be engageable with the ratchet teeth 135 of the rotary member 133.

The ratchet pawls 136 each include a flat surface portion 136*a* and an inclined surface portion 136*b*. The shape of the flat surface portions 136*a* corresponds to the shape of the flat surface portions 135*a* of the ratchet teeth 135. Also, the shape of the inclined surface portions 136*b* corresponds to the shape of the inclined surface portions 135*b* of the ratchet teeth 135. When the ratchet teeth 135 engage with the ratchet pawls 136, the flat surface portions 135*a* come into contact with the flat surface portions 136*a*, while the inclined surface portions 135*b* come into contact with the inclined surface portions 136*b*.

The restricting member 134 of the fixing device 10A in the present embodiment is provided so as not to rotate the rotary member 133 in any rotation directions (the first direction A and the direction C). Accordingly, even when a force to rotate in the direction C is applied to the rotary member 133 in the state in which the ratchet teeth 135 of the rotary member 133 engage with the ratchet pawls 136 of the restricting member 134, the rotation of the rotary member 133 in the direction C is restricted by contact between the flat surface portions 136*a* of the ratchet pawls 136 and the flat surface portions 135*a* of the ratchet teeth 135.

By contrast, when a force to rotate in the first direction A is applied to the rotary member 133, the inclined surface portions 135*b* of the ratchet teeth 135 slip on the inclined surface portions 136*b* of the ratchet pawls 136 to separate the ratchet teeth 135 from the ratchet pawls 136. This releases engagement between the ratchet teeth 135 and the ratchet pawls 136, thereby allowing the rotary member 133 to rotate in the first direction A. It is noted that the rotary member 133 and the restricting member 134 are preferably held so that the ratchet pawls 136 are capable of engaging with the ratchet teeth 135 again after rotation of the rotary member 133.

As described above, in the present embodiment, the separation roller 13 includes a ratchet mechanism as a rotation direction restricting mechanism. Further, the rotation direction restricting mechanism restricts the rotation of the rotary member 133 of the separation roller 13 in the predetermined direction. Thus, the rotary member 133 can be rotatable only in the first direction A. However, the rotation direction restricting mechanism is not limited to the ratchet mechanism. In one example, the separation roller 13 may include a one-way clutch mechanism as the rotation direction restricting mechanism.

Third Embodiment

Figure 5A:
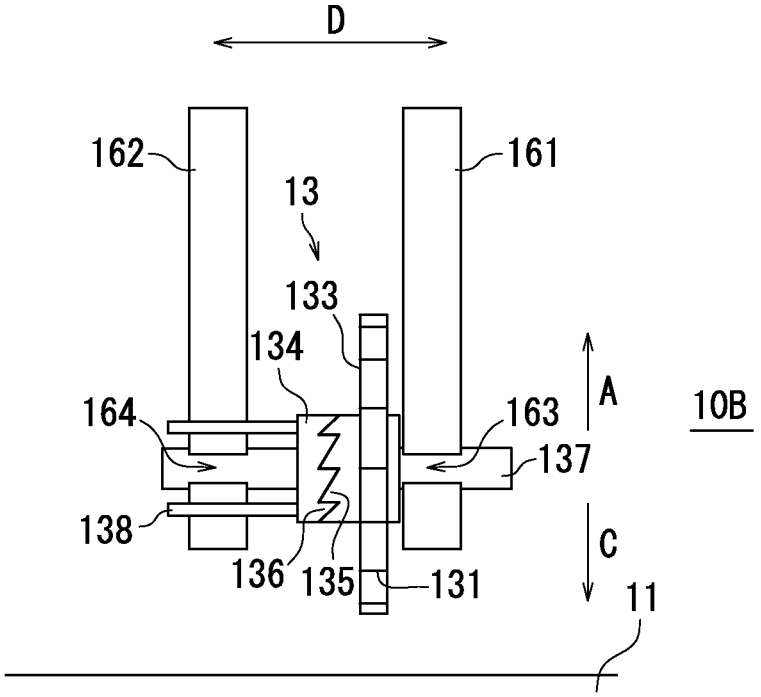
FIG. 5A is a front view showing a fixing device according to the third embodiment of the present disclosure.
Figure 5B:
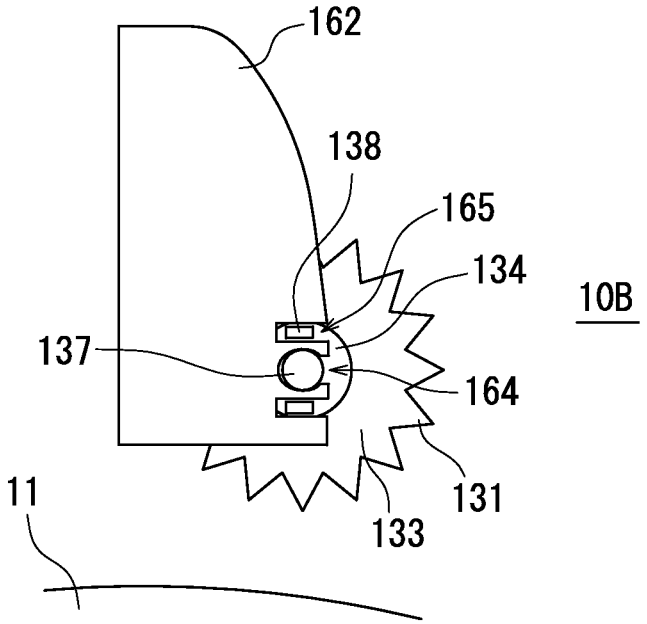
FIG. 5B is a side view showing the fixing device according to the third embodiment of the present disclosure.

FIG. 5 presents schematic illustrations showing a fixing device 10B according to the third embodiment of the present disclosure. FIG. 5A is a front view of the fixing device 10B. FIG. 5B is a side view of the fixing device 10B. With reference mainly to FIG. 5, the third embodiment of the present disclosure will be described below with focus placed upon difference from the second embodiment. Like numerals denote like elements shown in FIGS. 1-4 for explanation. Description overlapping with that of the first or second embodiment will be omitted or simplified.

A fixing device 10B according to the present embodiment includes a first support member 161 and a second support member 162 in addition to a fixing member 11, a pressure member 12 (not shown in FIG. 5), and a separation roller 13. The fixing member 11 and the pressure member 12 in the present embodiment have configurations similar to those of the fixing member 11 and the pressure member 12 in the second embodiment, respectively.

The first and second support members 161 and 162 support the separation roller 13. The first support member 161 is spaced a predetermined distance apart from the second support member 162. Each of the first and second support members 161 and 162 can be a guide member to guide conveyance of paper P. It is noted that the first and second support members 161 and 162 are separate members independent of each other in the present embodiment. However, the first and second support member 161 and 162 are not limited thereto and may be formed integrally.

The separation roller 13 includes a rotary member 133 and a restricting member 134. The rotary member 133 and the restricting member 134 are arranged between the first support member 161 and the second support member 162.

The rotary member 133 in the present embodiment includes a rotary shaft 137 extending in a direction D. The rotary member 133 in the present embodiment has a configuration similar to that of the rotary member 133 in the second embodiment (see FIG. 4), except that the rotary shaft 137 is provided.

The rotary shaft 137 of the rotary member 133 is rotatably supported by the first and second support members 161 and 162. In one example, one end portion of the rotary shaft 137 is inserted in a shaft hole 163 formed in the first support member 161. Also, the other end portion of the rotary shaft 137 is inserted in a shaft hole 164 formed in the second support member 162. It is noted that it is preferable that the shaft hole 163 opens in a side surface of the support member 161, while the shaft hole 164 opens in a side surface of the support member 162. This can achieve easy fitting of the rotary shaft 137 to the first and second support members 161 and 162.

The restricting member 134 in the present embodiment includes sliding guides 138. The restricting member 134 in the present embodiment has a configuration similar to that of the restricting member 134 in the second embodiment (see FIG. 4), except that the sliding guides 138 are provided.

The sliding guides 138 of the restricting member 134 are slidably supported by the second support member 162. In the present embodiment, the restricting member 134 includes two sliding guides 138. The sliding guides 138 are inserted in holes 165 formed in the second support member 162. Following the sliding guides 138, the restricting member 134 can slide toward or away from the rotary member 133. When the restricting member 134 slides toward the rotary member 133, the ratchet pawls 136 can engage with the ratchet teeth 135.

It is noted that a ring-shaped restricting member 134 may be fitted to the rotary shaft 137 of the rotary member 133. In one example, a central hole may be formed in the restricting member 134, and the rotary shaft 137 of the rotary member 133 may be inserted slidably in the central hole. This can allow the restricting member 134 to more stably slide toward and away from the rotary member 133.

In the fixing device 10B of the present embodiment described above, engagement between the ratchet teeth 135 and the ratchet pawls 136 can cause the rotation direction restricting mechanism to restrict the rotation of the rotary member 133 in the predetermined direction, thereby allowing the rotary member 133 to rotate only in the first direction A.

When the rotary member 133 is rotated in the first direction A, the inclined surface portions 135*b* of the ratchet teeth 135 slide on the inclined surface portions 136*b* of the ratchet pawls 136. This causes the restricting member 134 to slide away from the rotary member 133. Thus, the engagement between the ratchet teeth 135 and the ratchet pawls 136 is released, thereby allowing the rotary member 133 to rotate in the first direction A. It is noted that it is preferable that the restricting member 134 automatically slides toward the rotary member 133 so that the ratchet pawls 136 engage with the ratchet teeth 135 again after rotation of the rotary member 133.

Fourth Embodiment

Figure 6:
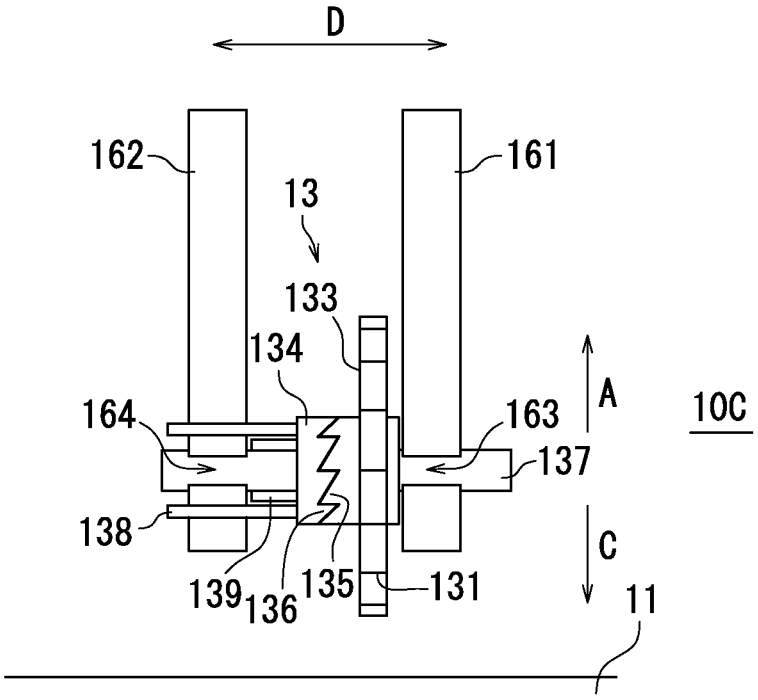
FIG. 6 is a diagram showing a fixing device according to the fourth embodiment the present disclosure.

FIG. 6 is a diagram showing a fixing device 10C according to the fourth embodiment of the present disclosure. With reference mainly to FIG. 6, the fourth embodiment of the present disclosure will be described below with focus placed upon difference from the third embodiment. Like numerals denote like elements shown in FIGS. 1-5 for explanation. Description overlapping with that of the first to third embodiments will be omitted or simplified.

The fixing device 10C according to the present embodiment has a configuration similar to that of the fixing device 10B of the third embodiment (see FIG. 5), except that the separation roller 13 includes an urging member 139. The urging member 139 of the fixing device 10C is an elastic member, such as a spring or rubber, for example.

The urging member 139 is interposed between a restricting member 134 and a second support member 162. The urging member 139 urges the restricting member 134 so that ratchet pawls 136 of the restricting member 134 engage with ratchet teeth 135 of a rotary member 133. In the present embodiment, a ring-shaped urging member 139 is fitted to a rotary shaft 137 of the rotary member 133.

The urging member 139 applies an urging force to the restricting member 134. The urging force makes the restricting member 134 to slide toward the rotary member 133. The urging force has preferably a strength to such a degree that paper P can push and rotate the rotary member 133 to allow the restricting member 134 to slide in a direction away from the rotary member 133.

Thus, in the fixing device 10C according to the present embodiment described above, the urging force by the urging member 139 causes the restricting member 134 to slide toward the rotary member 133 after the engagement between the ratchet teeth 135 and the ratchet pawls 136 is released, thereby allowing the rotary member 133 to rotate. Thus, the ratchet pawls 136 engage with the ratchet teeth 135 again. As a result, the rotation direction restricting mechanism can restrict again the rotation of the rotary member 133 in the predetermined direction.

Fifth Embodiment

Figure 7:
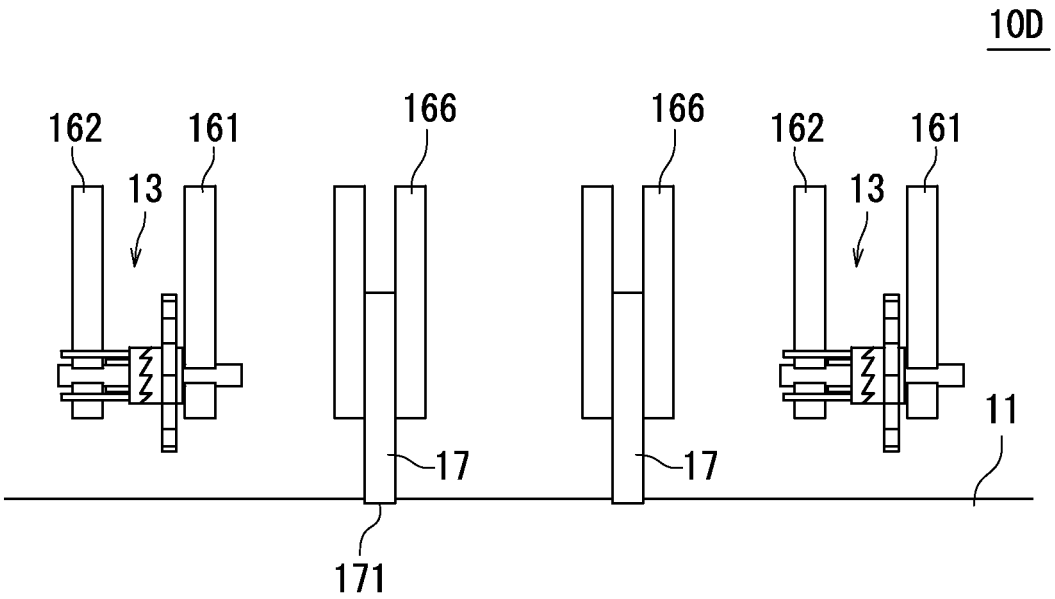
FIG. 7 is a diagram showing a fixing device according to the fifth embodiment of the present disclosure.

FIG. 7 is a diagram showing a fixing device 10D according to the fifth embodiment of the present disclosure. With reference mainly to FIG. 7, the fifth embodiment of the present disclosure will be described below with focus placed upon difference from the fourth embodiment. Like numerals denote like elements shown in FIGS. 1-6 for explanation. Description overlapping with that of the first to fourth embodiments will be omitted or simplified.

A fixing device 10D according to the present embodiment includes separation rollers 13 and separation claws 17 as separation members to separate paper P from a fixing member 11. Each separation roller 13 in the present embodiment has a configuration similar to that of the separation roller 13 in the fourth embodiment (see FIG. 6).

The separation claws 17 separate paper P wound around the fixing member 11 from the fixing member 11. The separation claws 17 each have an acute tip end portion 171. The separation claws 17 are arranged downstream of the fixing member 11 in the conveyance direction X. Each separation claw 17 is arranged so that the tip end portion 171 is in contact with the outer peripheral surface of the fixing member 11.

Each separation claw 17 is supported by third support members 166. Each third support member 166 may be a guide member to guide conveyance of the paper P. Further, any of the third support members 166 may be integrally formed with the first support member 161 or the second support member 162.

The fixing device 10D of the present embodiment includes two separation rollers 13 and two separation claws 17. However, the fixing device 10D may include only one or two or more separation rollers 13 or separation claws 17.

The fixing device 10D of the present embodiment includes, in addition to the separation rollers 13, separation claws 17 as separation members to separate the paper P from the fixing member 11. Thus, the separation claws 17 and the separation rollers 13 can separate the paper P from the fixing member 11, while the separation rollers 13 can guide the paper P downstream in the conveyance direction X.

It is noted that where the fixing device 10D includes a plurality of the separation rollers 13, the separation claw(s) 17 is/are preferably interposed between the separation rollers 13 as shown in FIG. 7, for example. Further, when such the fixing device 10D is heated, the heat might be conducted to the central part from the opposite ends of the fixing member 11 in the direction of the axis. Accordingly, the temperature of the opposite ends may be higher than that of the central part of the fixing member 11. When the temperature becomes high, the coating layers on the separation claws 17 may be softened to tend to be worn out. Accordingly, in order to reduce wearing out of the separation claws 17, it is preferable to arrange the separation claws 17 around the center of the fixing member 11.

Sixth Embodiment

Figure 8:
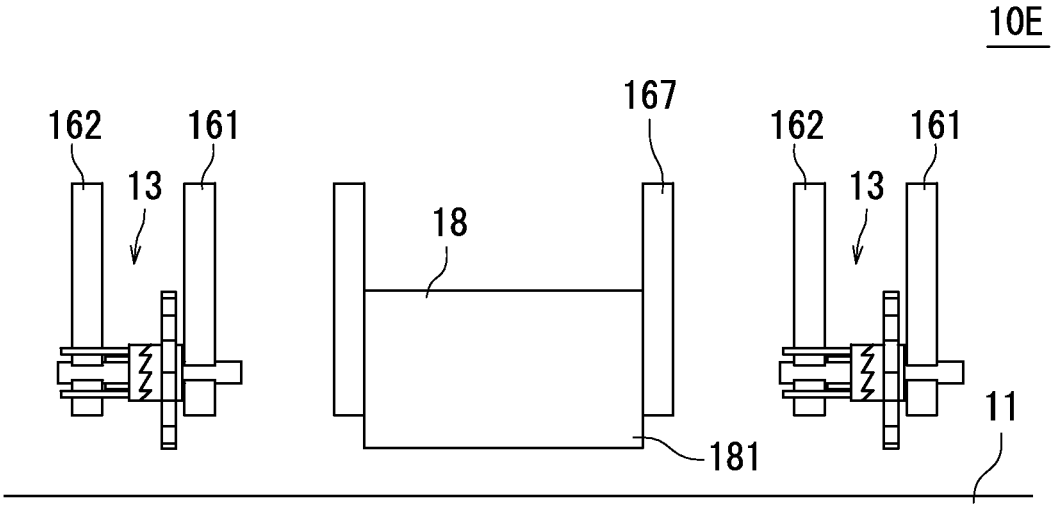
FIG. 8 is a diagram showing a fixing device according to the sixth embodiment of the present disclosure.

FIG. 8 is a diagram showing a fixing device 10E according to the sixth embodiment of the present disclosure. With reference mainly to FIG. 8, the sixth embodiment of the present disclosure will be described below with focus placed upon difference from the fourth embodiment. Like numerals denote like elements shown in FIGS. 1-6 for explanation. Description overlapping with that of the first to fifth embodiments will be omitted or simplified.

A fixing device 10E according to the present embodiment includes separation rollers 13 and a separation plate 18 as separation members to separate paper P from a fixing member 11. Each separation roller 13 in the present embodiment has a configuration similar to that of the separation roller 13 in the fourth embodiment (see FIG. 6).

The separation plate 18 separates paper P wound around the fixing member 11 from the fixing member 11. The separation plate 18 has an acute tip end 181. The separation plate 18 is arranged downstream of the fixing member 11 in the conveyance direction X. The separation plate 18 is arranged such that the tip end 181 of itself is spaced a predetermined distance apart from the outer peripheral surface of the fixing member 11. The separation plate 18 is arranged to be out of contact with the fixing member 11.

Fourth support members 167 support the separation plate 18. Each fourth support member 167 may be a guide member to guide conveyance of paper P. Further, the respective fourth support members 166 may be formed integrally with the first support member 161 or the second support member 162.

The fixing device 10E of the present embodiment includes the separation plate 18 in addition to separation rollers 13, as separation members to separate paper P from the fixing member 11. The separation rollers 13 and the separation plate 18 can cooperate to separate the paper P from the fixing member 11, while the separation rollers 13 can guide the paper P downstream in the conveyance direction X.

It is noted that similarly to the fifth embodiment, the fixing device 10E of the present embodiment may include only one or two or more separation rollers 13 or separation plates 18. Further, where the fixing device 10E includes a plurality of the separation rollers 13, the separation plate(s) 18 is/are preferably arranged between the separation rollers 13.

Other Embodiment

The fifth or sixth embodiment may be changed such that the separation claws 17 or the separation plate 18 are/is made of heat resistant resin. Further, each separation claw 17 or the separation plate 18 may include a fluororesin layer on its surface. In one example, the surface of any of the separation claws 17 and the separation plate 18 may be coated with fluororesin.

Any of the separation roller(s) 13, the separation claws 17, and the separation plate 18 are provided only on the side of the fixing member 11 in the above described embodiments. However, the present disclosure is not limited thereto. The separation roller(s) 13, the separation claws 17, or the separation plate 18 may be provided on the side of the pressure member 12. Moreover, any of the separation roller(s) 13, the separation claws 17, or the separation plate 18 may be provided on each side of the fixing member 11 and the pressure member 12.

In one example, when the surface of paper P on which a toner image is formed comes into contact with the pressure member 12 at the time when the paper P passes through the nip 15, the paper P may be wound around the pressure member 12 in the image forming apparatus 100. In order to separate the paper P wound around the pressure member 12, any of the separation roller(s) 13, the separation claws 17, and the separation plate 18 may be preferably provided on the side of the pressure member 12. In this case, the separation roller(s) 13 preferably rotate(s) only in the same direction as the second direction B in which the pressure member 12 rotates.

Furthermore, in an image forming apparatus or the like having a duplex printing function, paper P may be wound around the pressure member 12 as well as the fixing member 11. To tackle this problem, any of the separation roller(s) 13 (first separation roller and second separation roller), the separation claws 17, and the separation plate 18 (first separation member and second separation member) may be preferably provided on each side of the fixing member 11 and the pressure member 12.

What is claimed is:

1. A fixing device comprising:
a fixing member configured to rotate in a first direction;
a pressure member configured to rotate in a second direction to allow a fixing target to pass between itself and the fixing member;
at least one separation roller configured to rotate only in the same direction as the first direction to separate the fixing target from the fixing member; and
a rotation direction restricting mechanism configured to allow the at least one separation roller to rotate only in the first direction.

2. A fixing device according to claim 1, wherein
the at least one separation roller is arranged so as to be out of contact with the fixing member.

3. A fixing device according to claim 1, wherein
the at least one separation roller includes as the rotation direction restricting mechanism:
a rotary member which is provided rotatably and on which ratchet teeth are formed; and
a restricting member at which ratchet pawls are formed, the ratchet pawls being configured to restrict rotation of the rotary member in a predetermined direction by engaging with the ratchet teeth of the rotary member.

4. A fixing device according to claim 3, further comprising:
a first support member and a second support member,
wherein the rotary member is arranged between the first support member and the second support member, and
the restricting member is arranged between the first support member and the second support member slidably toward the rotary member so that the ratchet pawls engage with the ratchet teeth.

5. A fixing device according to claim 4, wherein
the rotary member includes a rotary shaft,
the rotary shaft of the rotary member is supported rotatably by the first support member and the second support member,
the restricting member is fitted to the rotary shaft of the rotary member, the restricting member having a ring shape,
the restricting member includes a sliding guide, and
the sliding guide of the restricting member is slidably supported by the second support member.

6. A fixing device according to claim 3, wherein
the at least one separation roller includes an urging member configured to urge the restricting member so that the ratchet pawls engage with the ratchet teeth.

7. A fixing device according to claim 1, wherein
projected portions or recessed portions are formed on or in an outer peripheral surface of the at least one separation roller.

8. A fixing device according to claim 1, wherein
the at least one separation roller is made of heat resistant resin.

9. A fixing device according to claim 1, wherein
the at least one separation roller includes on a surface thereof a fluororesin layer.

10. A fixing device according to claim 1, further comprising, in addition to the at least one separation roller,
a separation member configured to separate the fixing target from the fixing member.

11. A fixing device according to claim 10, wherein
the at least one separation roller includes a plurality of separation rollers, and the separation member is arranged between the separation rollers.

12. An image forming apparatus comprising a fixing device according to claim 1.

13. A fixing device comprising:
a fixing member configured to rotate in a first direction;
a pressure member configured to rotate in a second direction to allow a fixing target to pass between itself and the fixing member; and
at least one separation roller configured to rotate only in the same direction as the second direction to separate the fixing target from the pressure member.

14. A fixing device according to claim 13, wherein
the at least one separation roller is arranged so as to be out of contact with the pressure member.

15. A fixing device according to claim 13, further comprising:

a rotation direction restricting mechanism configured to allow the at least one separation roller to rotate only in the second direction.

16. An image forming apparatus comprising:

a fixing device according to claim 13.

17. A fixing device comprising:

a fixing member configured to rotate in a first direction;

a pressure member configured to rotate in a second direction to allow a fixing target to pass between itself and the fixing member;

a first separation roller configured to rotate only in the same direction as the first direction to separate the fixing target from the fixing member; and a second separation roller configured to rotate only in the same direction as the second direction to separate the fixing target from the pressure member.

18. A fixing device according to claim 17, further comprising:

a first separation member configured to separate the fixing target from the fixing member besides the first separation roller; and a second separation member configured to separate the fixing target from the pressure member besides the second separation roller.

19. An image forming apparatus comprising:

a fixing device according to claim 17.

* * * * *